US007303361B1

(12) United States Patent
Lane

(10) Patent No.: US 7,303,361 B1
(45) Date of Patent: Dec. 4, 2007

(54) CONCRETE FORM WITH KEYWAY AND CLAMP WITH BASE ENGAGING THE KEYWAY

(76) Inventor: Michael Lane, 14114 SE. 16 2 Pl., Renton, WA (US) 98055

( * ) Notice: Subject to any disclaimer, the term of this patent is extended or adjusted under 35 U.S.C. 154(b) by 0 days.

(21) Appl. No.: 11/532,031

(22) Filed: Sep. 14, 2006

(51) Int. Cl.
*E04G 9/10* (2006.01)

(52) U.S. Cl. ..... 405/287; 249/1; 249/66.1

(58) Field of Classification Search ..... 405/287; 249/1, 66.1
See application file for complete search history.

(56) References Cited

U.S. PATENT DOCUMENTS 3,555,830 A * 1/1971 York ..... 405/285
3,749,432 A * 7/1973 Janssen ..... 52/476
5,015,117 A * 5/1991 Pawlicki ..... 403/300
6,712,546 B1 * 3/2004 Radu et al. ..... 404/8
7,144,184 B1 * 12/2006 Tsai ..... 403/350

* cited by examiner

*Primary Examiner*—Tara L. Mayo
(74) *Attorney, Agent, or Firm*—David L Tingey

(57) ABSTRACT

A concrete form with a keyway with an opening between opposing keyway lips together with a base that fits through the keyway opening and rotates without restriction in the keyway such that a portion of the base rests behind the keyway lips so when it is pulled as a clamp or tie is exercised to secure a stake to the form the base is secured tight against the form front. The concrete form further has at least one brace wall extending between intermediate the keyway back wall and the form back. Form end connectors securable in form ends are provided that join two forms aligned end to end.

15 Claims, 5 Drawing Sheets

CONCRETE FORM WITH KEYWAY AND CLAMP WITH BASE ENGAGING THE KEYWAY

BACKGROUND

1. Field of the Invention

This invention relates to construction forms for installing concrete, and more particularly, to a polyethylene concrete form with a keyway that receives a base of a clamp that locks the concrete form to a stake and also relates to a concrete form end connector.

2. Prior Art

Concrete forms form the retaining walls between which concrete is poured and held until the concrete sufficiently hardens for the forms to be removed. The concrete forms are historically made of wood or steel and more recently of extruded polyethylene as well documented by Pawlicki in U.S. Pat. No. 5,015,117 issued in 1991. Where wood could be reused only a few times, extruded polyethylene forms can be used repeatedly for years and, unlike steel forms, they are lightweight for ease in transporting them.

The polyethylene concrete form described by Pawlicki further included a dovetailed keyway in a side into which is received a base of a clamp that secures a stake to the form. The base and keyway were matched such that the base fit through the keyway opening in a first orientation and then when rotated distorted the keyway slightly at about 45 degrees rotation as the base is rotated 90 degrees, providing resistance to inadvertent counter rotation and consequent release of the base out of the keyway. The resistance through the base corners against the keyway during rotation is effective but tends to wear out the base corners prematurely. The base also matched the dove-tailed form of the keyway such that when the base is rotated into installed position, the base is in binding face to face contact with the dove-tailed portion of the keyway and the bottom of the base also is pushed against the back of the keyway. The clamp is thus secured tightly to the form extending orthogonally from the form.

Pawlicki also described end connectors for the polyethylene concrete forms. The end connectors included a pair of posts each with a circumferential rim matching a pair of holes when two connectors are oriented face to face, the rims sized slightly larger than the holes so the post must be urged for a degree of force into the hole with the rims being pushed past the hole, resulting in resistance to one connector falling out of connection with another connector.

It is an object of the present invention to provide a polyethylene concrete form with a keyway with parallel opposing sides, unlike the dove-tailed keyway of Pawlicki, in which may be received a clamp base without distorting the keyway or clamp base. To strengthen the keyway, it is further object that the form have at least one as a keyway brace extending from intermediate the back of the keyway to an opposite form side. It is a further object to provide a base sized and shaped to fit through the keyway opening in a first orientation and when rotated in the keyway is prevented from falling out of the keyway. It is another object that the clamp base is rotatable in the keyway without restriction by the keyway.

SUMMARY

These objects are achieved in a polyethylene concrete form with a front and a back and with a keyway with an opening and nominally parallel keyway front and back walls. Thus structured in a general keyway shape, the keyway is amenable to receive therein a variety of clamp bases, specifically including bases not necessarily sized to match the keyway in tight face-to-face contact. That is, any clamp with a base having a flat bottom that can fit through the keyway opening can be secured to the concrete form if it can rotate somewhat in the keyway to a secure, or locking position such that a portion of the base rests behind the keyway front wall so when it is pulled as the clamp is exercised to clamp, for example, a stake to the form the base is secured tight against the front.

Preferably, the clamp base matches the keyway. That is, a base vertical, or narrow, dimension is of dimension such that it passes easily into the keyway. The keyway has a dimension between the keyway sides. Preferably, the base horizontal dimension is less than or equal to the keyway dimension between its sides. Preferably, the base has rounded corners so the base can be rotated in the keyway without binding. Thus, when the base inserted in the keyway is rotated up to 90 degrees the base rotates into locking position partially behind the keyway front wall without binding in or distorting the keyway. A stop is provided on the base to prevent rotation of the base beyond its locking position. The concrete form further has at least one brace wall extending between intermediate the keyway back wall to the form back. Preferably the form has two brace walls near but spaced apart from keyway sides to strengthen the keyway.

Typically, the form is held in place by stakes in the ground in conventional manner. The form keyway is provided with the intent that a clamp be secured therein positioned along the keyway at a preferred position alongside a stake. The clamp secures the stake to the form. Clearly, any clamp effective in securing the stake to the concrete form can be employed. For example, a clamp with an arm extending to its base that is secured within the keyway may employ a cam on a handle that rotates on the clamp arm. As the handle is rotated, the cam binds the stake between the cam and the concrete form alongside the keyway, pulling the clamp base against the keyway front wall.

DETAILED DESCRIPTION OF THE PREFERRED EMBODIMENTS

Figure 1:
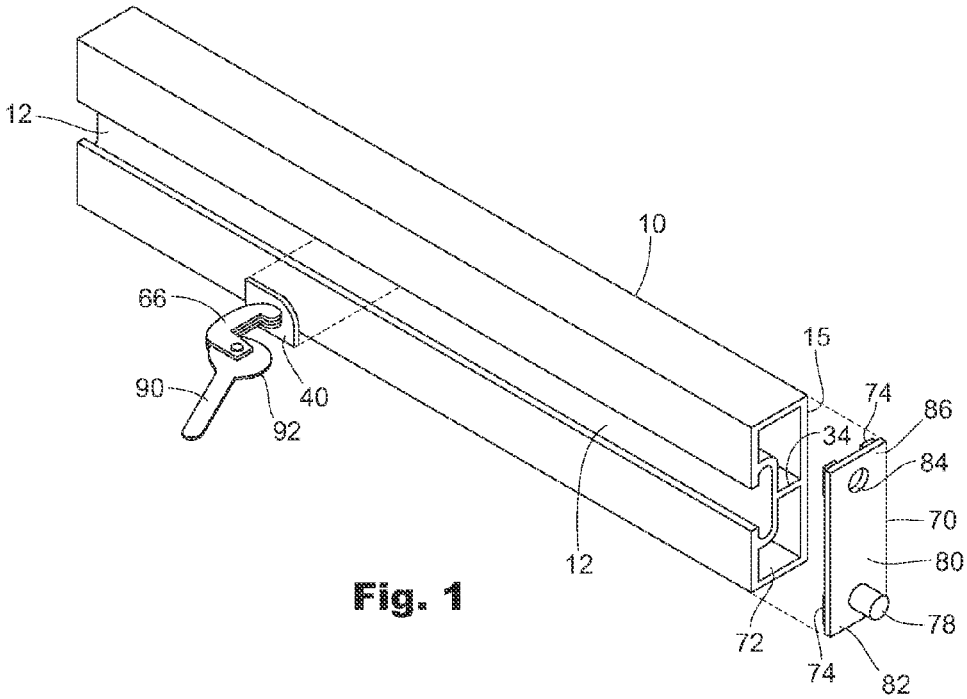
FIG. 1 is a perspective view a concrete form with clamp opposite a form keyway and an end connector opposite a form end.
Figure 2:
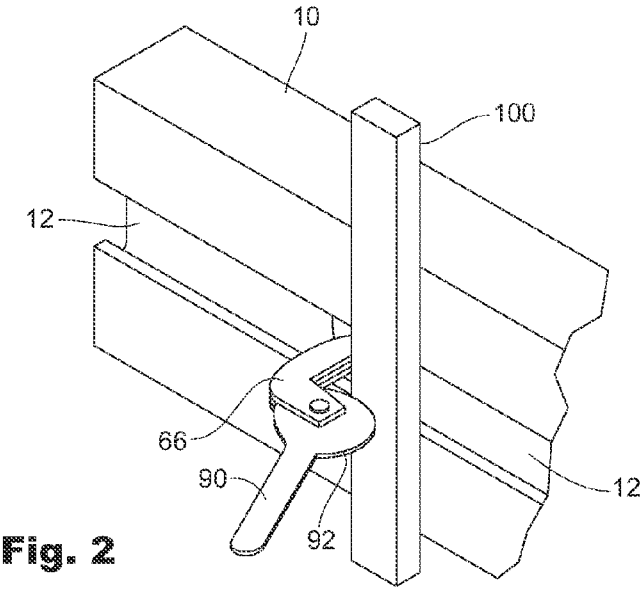
FIG. 2 is a perspective view of the concrete form of FIG. 1 with the clamp of FIG. 1 installed in the form keyway and clamping a stake to the form.
Figure 3:
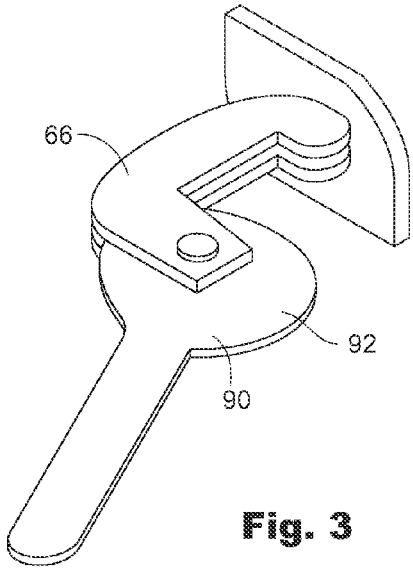
FIG. 3 is a perspective view of the clamp of FIG. 1 and FIG. 2.
Figure 4:
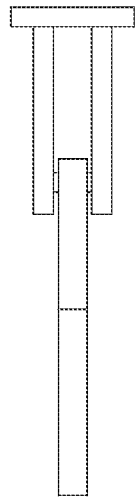
FIG. 4 is a top view of the clamp of FIG. 3.
Figure 5:
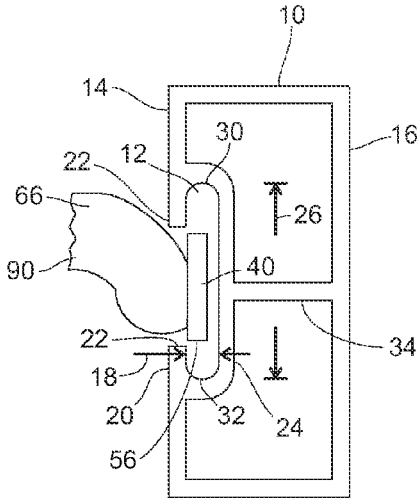
FIG. 5 is an end view of the form of FIG. 1 showing a form dividing wall bracing the keyway and the clamp base inserted within the keyway.
Figure 6:
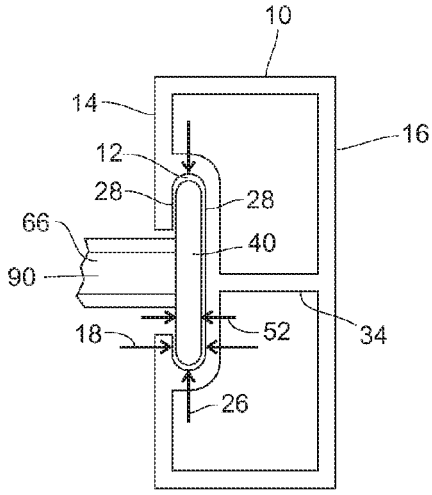
FIG. 6 is an end view of the form and clamp of FIG. 5 with the clamp rotated so that its longer side of its rectangular base is behind the keyway front.
Figure 7:
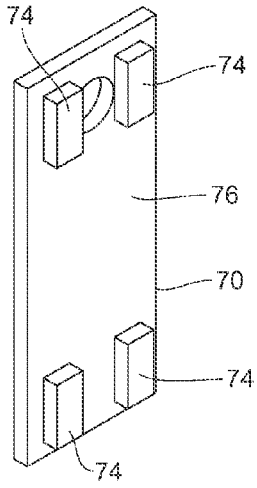
FIG. 7 is a back view of the end connector of FIG. 1.
Figure 8:
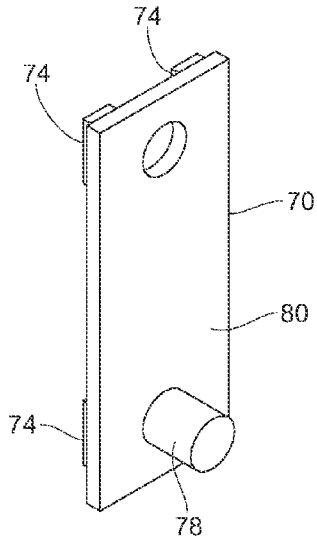
FIG. 8 is a front view of the end connector of FIG. 1.
Figure 9:
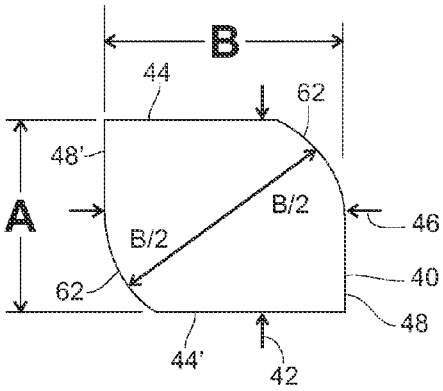
FIG. 9 is a bottom view a first embodiment the clamp base with a rectangular base and two rounded corners diagonally opposed for a 90 degree rotation within the keyway.
Figure 10:
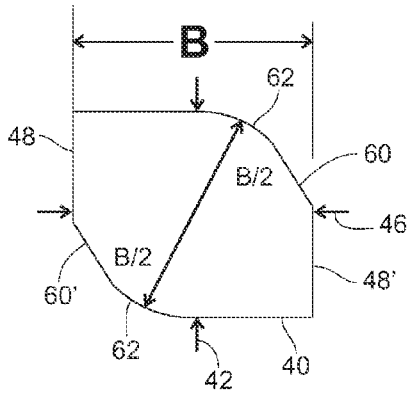
FIG. 10 is a bottom view a first embodiment the clamp base with a rectangular base and two corners cut in a flat diagonally opposed each with a curve joining the flat with the narrow side of the rectangle for a 45 degree rotation within the keyway.
Figure 11:
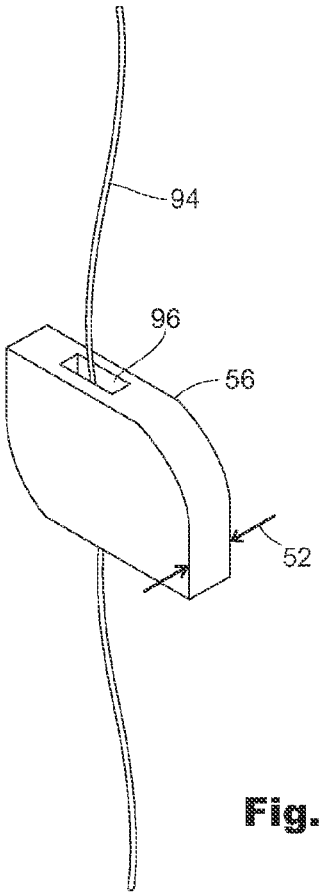
FIG. 11 is a perspective view of a base having a through channel through which a twist tie passes.
Figure 12:
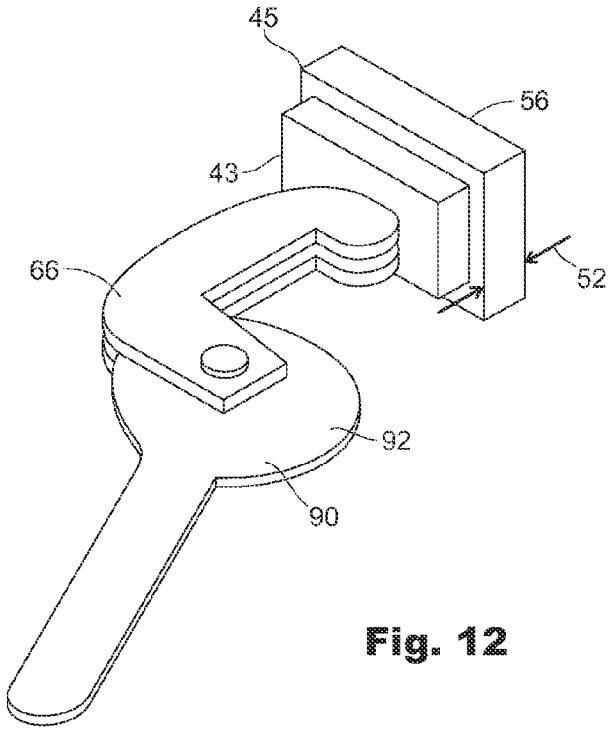
FIG. 12 is a perspective view of a concrete form with the base of FIG. 11 in the form keyway and a twist tie wrapped from the base around a stake, securing the form to the stake.
Figure 13:
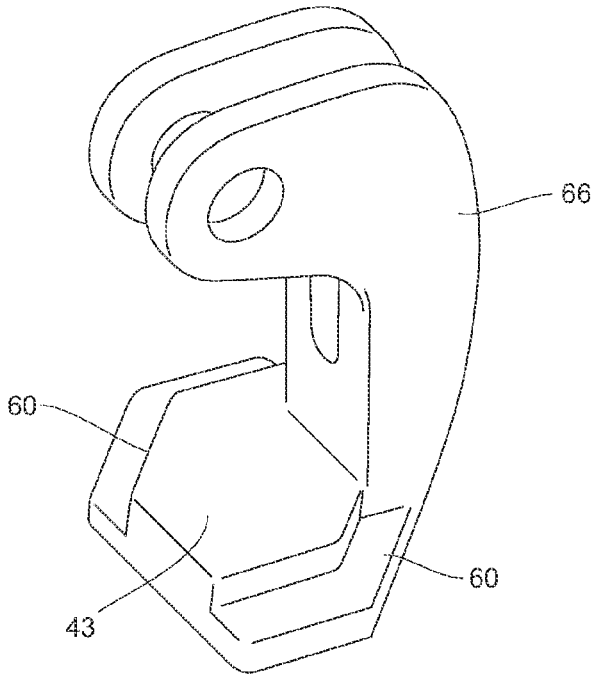
FIG. 13 is a perspective view of the clamp with a clamp base connected to a securing mechanism with a shelf portion therebetween.

An elongate concrete form 10 primarily of polyethylene plastic material generally in the shape of a plank of lumber comprises a keyway 12 on a form front side 14 opposite a back side 16. The keyway 12 has a width 18 between a keyway front 20 with opposing lips 22, a keyway back 24, and a height 26 orthogonal to its width 18, and the opening as an entrance into the keyway 12 between the opposing lips 22. The keyway front 20 and back 24 are generally parallel or have parallel portions 28, recognizing that the keyway top 30 and bottom 32 may be curved, in which case the front 20 will be a mirror image of an opposing portion of the back 24 and the parallel portions 28 are the lips 22 and the back 24. For purposes herein, the distinction is irrelevant and reference to front and back parallel portions 22 and 24 is meant to include a curved keyway top and bottom 30, 32. The concrete form 10 also includes at least one dividing wall 34 to strengthen the form 10. The concrete form 10 may be provided in several sizes. The number of dividing walls generally increases with increased form size. As representative, the concrete form 10 is divided internally by a single wall for a 4" form (height) and by three parallel walls for a 6" form with at least one wall extending between intermediate the keyway back 24 and the form back side 16 as a brace on the keyway 12. Form sizes may also include 8", 10" and 12" and other sizes.

A generally rectangular clamp base 40 that turns up to 90 degrees, and preferably 45 degrees, in the keyway 12 is sized to turn for connection to the concrete form keyway 12 without restriction by the keyway 12, that is, without binding in the keyway or distorting the keyway. The clamp base narrow dimension 42 between first parallel sides 44, 44' is sized such that the base 40 fits through the keyway opening 12 between keyway lips 22. Generally, the narrow dimension 42 is less than the keyway opening 12 or such slightly larger dimension that still allows near orthogonal entry into the keyway 12. The clamp base wide dimension 46 between second parallel sides 48, 48' is greater than the keyway opening 12 and no greater than the height 40 of the keyway 12 between the keyway top 30 and bottom 32. The clamp base 40 is sized to fit in the keyway 12 between the keyway front 20 and back 24 therefore with a base thickness 52 no greater than the keyway width 18. The base 40 is inserted into the keyway 12 with the base bottom 56 generally opposite the keyway back 24 or approximately so if the base bottom 56 is tilted to fit partially into a keyway upper or lower portion and then fully into the keyway 12 and the base 40 oriented so its narrow dimension 42 is aligned to fit through the keyway opening 12. The clamp base 40 is then rotated such that its wide dimension 46 extends behind the keyway lips 22. The clamp base 40 comprises a shelf portion 43 as a rotational stop that extends from an insert portion 45. With the insert portion 45 within the keyway, the shelf portion 43 extends between opposing keyway lips 22. When the base rotates to its locking position, a flat 60 on the shelf portion 43 abuts one or both keyway lips 22.

Two embodiments illustrate the clamp base design range of a clamp that turns up to 90 degrees. The rectangular clamp base 40 has opposing first parallel sides 44, 44' and opposing second parallel sides 48, 48' orthogonal thereto. The base also has a pair of parallel flats 60, 60'. For each flat 60, 60', a curve 62 may connect a flat 60 to one of said first parallel sides 44, 44'. The curve 62 is preferably circular with a radius of half the rectangle wide dimension B to avoid restriction of the base 40 in the keyway 16 when the base 40 is turned. A smaller wide dimension B obviates the need for a curve 62. In a first embodiment, for a 90-degree clamp rotation, the parallel flats 60, 60' are coincident with the second parallel sides . In a second embodiment, for a 45-degree clamp rotation, the parallel flats are 45 degrees to the first parallel sides 42 with a second flat 60 connecting to one of the second parallel sides 48, 48'for each flat 60, 60'. Thus there is no locking action between the base 40 and the keyway 12 occasioned by the turning of the clamp base 40 in the keyway 12. In general then, for a base rotation of selected degrees D required to secure the base 40 in the keyway 12, for each said flat 60, 60' a virtual extension E of said flat 60, 60'intersects a virtual extension S of said first parallel side 44, 44'at said selected degrees D, the base 40 adapted to receive connection to a securing mechanism 66 that is adapted to receive a stake 100 in securing the concrete form 10 to the stake 100.

A pair of connectors 70 is provided that fit in ends 72 of the form 10 to close the form 10. The connectors 70 comprise at least one lug 74 in the back side 76 of the connector 70 that matches the form end 72 to fit snugly therein to hold the connector 70 in the form end 72 . Commonly, a plurality of lugs 74, typically two or four, extend from the connector back side 76 to secure the connector 70 to the form end 72. The connectors 70 can also serve to join forms 10 end to end. The connectors 70 comprise a boss 78 protruding from the face 80 of the connector 70 on its upper part 82 and an orifice 84 generally the size of the boss 78 on its lower part 86 to snugly receive the boss 78 of an inverted connector 70. When the connectors 70 on respective ends 72, 72' of longitudinally aligned forms 10 come together, the boss 78 of each connector 70 fits snugly in the orifice 84 of the other.

In practice, the securing mechanism 66 may be a clamp 90 with a locking mechanism comprising a cam 92 with change of curvature binding the stake 100 as the cam 92 is turned. In an alternate embodiment, the securing mechanism 66 can simply be a twist tie 94 that passes through a channel 96 in (or equivalently on an underside of) the base and then around a stake 100. In both embodiments, the form 10 and a stake 100 are pulled tightly together as the securing mechanism 66 pulls the base 40 tightly against the keyway front 20 and lips 22 such that the base 40 is prevented from sliding in the keyway 12.

What is claimed is:

1. An elongate concrete form with a keyway in a form front opposite a form back and longitudinal with the form, the keyway having opposing lips spaced apart by an opening in the form front as an entrance to the keyway, the improvement comprising, a generally rectangular base with its circumference including opposing first sides in parallel spaced apart a narrow dimension sized to fit through the keyway opening and opposing second sides in parallel spaced apart a wide dimension sized to not fit through the keyway opening and alternating about the circumference with first sides, the base circumference further comprising a pair of flats in parallel each of which is circumferentially between a first and a second side with the wide dimension such as to enable the base to rotate in the keyway without restriction by the keyway, wherein for a base rotation of selected degrees required to secure the base in the keyway, for each said flat a virtual extension of said flat intersects a virtual extension of said first parallel side at said selected degrees, the base adapted to receive connection to a securing mechanism that is adapted to receive a stake in securing the concrete form to the stake.

2. The concrete form of claim 1 wherein said selected degrees are 90 degrees and the parallel flats are coincident with the second parallel sides.

3. The concrete form of claim 1 wherein said selected degrees are 45 degrees.

4. The concrete form of claim 1 wherein the base further comprises for each flat a curve connecting the flat said first parallel side therein wherein the curve is circular.

5. The concrete form of claim 1 wherein at least a portion of said keyway front and back are in parallel planes.

6. The concrete form of claim 1 wherein the keyway includes a back opposite the keyway lips, wherein said base wide dimension is greater than the keyway opening and no greater than the vertical extent of the back such that the base is freely rotatable in the keyway without restriction until pulled against the keyway lips by the securing mechanism.

7. The concrete form of claim 1 wherein the clamp base further comprises a shelf portion extending from an insert portion with the shelf portion as a rotational stop such that with the insert portion within the keyway, the shelf portion extends between opposing keyway lips, such that when the base rotates to its locking position, a flat on the shelf portion abuts one or both keyway lips.

8. The concrete form of claim 1 wherein the securing mechanism is a clamp.

9. The concrete form of claim 1 wherein the securing mechanism is a twist tie.

10. The concrete form of claim 9 wherein the base includes a channel through which the twist tie passes and from which the twist tie extends in tying a base to a stake.

11. The concrete form of claim 1 further comprising an end connector with a back adapted to fit securely in an end of the concrete form, comprising a single boss protruding from the face of the end connector on its upper part and an orifice generally the size of the boss on its lower part to snugly receive the boss of a same end connector inverted such that when end connectors on respective ends of longitudinally aligned forms come together, the boss of each end connector fits snugly in the orifice of the other.

12. The concrete form of claim 1 further comprising at least one dividing wall extending between intermediate the keyway back and the form back side as a brace on the keyway.

13. The method of securing a stake to a concrete form, the concrete form comprising a keyway with a key way back opposing a keyway front including a pair of opposing keyway lips, the keyway lips defining a keyway opening therebetween, (a) Inserting a partially rectangular base having orthogonal narrow and wide dimensions into the keyway through the keyway opening with a base bottom generally opposite the keyway back and the base oriented so its narrow dimension is aligned to fit through the keyway opening;

(b) Rotating the clamp base freely in the keyway without the clamp engaging the keyway such that its wide dimension extends between the keyway lips and the keyway back;

(c) Using a securing mechanism connected to the base, engaging the securing mechanism with the stake (d) pulling the base tight against the keyway front including the keyway lips as the securing mechanism tightly engages the stake against the form.

14. The method of claim 13 wherein the securing mechanism comprises a twist tie and the base comprises a channel, wherein steps (c) and (d) further include the following steps:

(e) passing the twist tie through the base channel;

(f) wrapping the stake with the twist tie;

(g) pulling the base tight against the keyway front and lips such that the base is prevented from sliding in the keyway;

(h) tightening the twist tie about the stake.

15. The method of claim 13 wherein the securing mechanism comprises a clamp connected to the base, the clamp including a cam, wherein steps (c) and (d) further include the following steps:

(e) engaging the stake with the clamp with the stake alongside the cam;

(f) rotating the cam to tightly engage the stake therein pulling the base tightly against the keyway front and lips such that the base is prevented from sliding in the keyway.

* * * * *